US011470911B2

(12) United States Patent
Cornett

(10) Patent No.: US 11,470,911 B2
(45) Date of Patent: Oct. 18, 2022

(54) CYCLING SHOE COVER

(71) Applicant: Lorri Cornett, Portland, OR (US)

(72) Inventor: Lorri Cornett, Portland, OR (US)

( * ) Notice: Subject to any disclaimer, the term of this patent is extended or adjusted under 35 U.S.C. 154(b) by 811 days.

(21) Appl. No.: 15/452,262

(22) Filed: Mar. 7, 2017

(65) Prior Publication Data

US 2018/0255867 A1 Sep. 13, 2018

(51) Int. Cl.

| | |
|---|---|
| ***A43B 3/24*** | (2006.01) |
| ***A43B 5/14*** | (2006.01) |
| ***A43B 1/00*** | (2006.01) |
| ***A43B 3/16*** | (2022.01) |
| ***A43B 5/18*** | (2006.01) |

(52) U.S. Cl.

CPC ..... *A43B 5/18* (2013.01); *A43B 3/16* (2013.01); *A43B 1/0009* (2013.01); *A43B 3/248* (2013.01); *A43B 5/14* (2013.01)

(58) Field of Classification Search

CPC .. A43B 5/18; A43B 3/16; A43B 3/248; A43B 5/14; A43B 1/0009

See application file for complete search history.

(56) References Cited

U.S. PATENT DOCUMENTS

| | | | | | |
|---|---|---|---|---|---|
| 301,311 | A * | 7/1884 | Whitehouse | A43B 3/16 | 36/7.3 |
| 1,396,313 | A * | 11/1921 | Belknap | A43B 3/16 | 36/32 R |
| 1,560,124 | A * | 11/1925 | Volkey | A43B 3/16 | 36/1 |
| 1,811,781 | A * | 6/1931 | Degge | A43B 3/16 | 36/135 |
| 2,068,238 | A * | 1/1937 | Malm | A43B 3/16 | 249/160 |
| 2,108,656 | A * | 2/1938 | De Noronha | A43B 3/16 | 36/3 A |
| 2,152,229 | A * | 3/1939 | Waters | A43B 3/16 | 36/7.3 |
| 2,254,685 | A * | 9/1941 | Jackson | A43B 3/16 | 36/58.5 |
| 2,458,438 | A * | 1/1949 | Snelling | A43B 3/16 | 36/55 |
| 2,617,209 | A * | 11/1952 | Jackson | A43B 3/16 | 36/54 |
| 2,787,063 | A * | 4/1957 | Austin | A43B 3/16 | 36/58.6 |

(Continued)

OTHER PUBLICATIONS

Product Website "Cleatskins for Cycling" 2011, Cleatskins, Inc., https://cleatskins.com/sport/cycling, (3 pages).

*Primary Examiner* — Katharine G Kane
(74) *Attorney, Agent, or Firm* — Nixon Peabody LLP

(57) ABSTRACT

A cycling shoe cover is disclosed for protection of a cycling shoe when a cyclist dismounts and desires to walk in the cycling shoe. The cycling shoe cover includes a pair of side panels. A toe is coupled to one end of each of the pair of side panels forming a front pocket mateable with the toe of a cycling shoe. A heel is coupled to the opposite end of each of the pair of side panels forming a back pocket mateable with the heel of a cycling shoe. A sole member has a bottom surface and is joined to the pair of side panels. The bottom surface of the sole member is interposed between the cycling shoe and a ground surface when the cycling shoe cover is worn over the cycling shoe.

13 Claims, 4 Drawing Sheets

(56) References Cited

U.S. PATENT DOCUMENTS 2,860,425 A * 11/1958 Jackson ..... A43B 3/16 36/58.5
2,958,963 A * 11/1960 Lougheed ..... A43B 5/18 36/7.5
3,026,635 A * 3/1962 Slade ..... A43B 3/16 168/18
3,313,047 A * 4/1967 Svien ..... A43B 5/18 36/7.3
3,621,592 A * 11/1971 Goldmerstein ..... A43B 3/16 36/138
3,718,993 A * 3/1973 Schovee ..... A43B 3/16 36/7.3
3,724,107 A * 4/1973 Makinen ..... A43B 3/16 36/7.3
4,055,005 A * 10/1977 Meinhart ..... A43B 5/14 36/135
4,258,483 A * 3/1981 Hogue ..... A43B 5/185 36/135
4,434,565 A * 3/1984 Haley ..... A43C 15/06 36/59 R
4,779,360 A * 10/1988 Bible ..... A43B 3/16 36/59 R
4,872,273 A * 10/1989 Smeed ..... A43B 5/185 36/135
5,031,342 A * 7/1991 Crook ..... A43B 5/14 36/135
5,197,207 A * 3/1993 Shorten ..... A43B 1/0009 36/102
5,315,767 A * 5/1994 Bradbury ..... A43B 3/16 36/135
5,425,186 A * 6/1995 Hoyt ..... A43B 3/16 36/4
5,548,910 A * 8/1996 Klingseis ..... A43B 5/185 36/135
6,860,038 B1 * 3/2005 Stucke ..... A43B 5/185 36/135
7,779,560 B2 * 8/2010 Kay ..... A43B 3/26 36/135
2003/0154626 A1 * 8/2003 Larson ..... A43B 3/16 36/7.6
2005/0229428 A1 * 10/2005 Holcomb ..... A43B 3/16 36/7.1 R
2007/0006490 A1 * 1/2007 Kay ..... A43B 3/26 36/135
2007/0113424 A1 * 5/2007 Bell ..... A43B 3/16 36/7.3
2008/0178492 A1 * 7/2008 Coomer ..... A43B 3/16 36/7.5
2008/0184592 A1 * 8/2008 Brie ..... A43B 3/16 36/7.1 R
2009/0307931 A1 * 12/2009 May ..... A43B 3/16 36/132
2010/0018080 A1 * 1/2010 Smith ..... A43B 3/24 36/102
2011/0258882 A1 * 10/2011 Jones ..... A43B 5/0419 36/132
2012/0124865 A1 * 5/2012 Opie ..... A43B 1/0009 36/73
2012/0266491 A1 * 10/2012 May ..... A43B 3/16 36/62
2012/0266492 A1 * 10/2012 Youngs ..... A43B 7/34 36/83
2016/0000175 A1 * 1/2016 Williams, Sr. ..... A43B 3/16 36/127
2016/0029739 A1 * 2/2016 Dias ..... A43B 1/02 36/103
2016/0037860 A1 * 2/2016 Holt ..... A43B 13/186 36/28

* cited by examiner

CYCLING SHOE COVER

TECHNICAL FIELD

This disclosure relates to a cover for a cycling shoe, more specifically a cycling shoe cover that may be inserted on a cycling shoe when a cyclist dismounts to protect the cycling shoe and the walking surface when the cyclist walks in the cycling shoe.

BACKGROUND

Cycling shoes are specialized shoes that include a cleat on the front portion of the sole of shoe. Typically, the cleat is mounted on a mounting plate located on the front of the sole of the cycling shoe. The cleat is used to lock into a toe clip on a bicycle pedal to allow the cyclist to transfer greater force to the pedal and therefore cycle more efficiently. The soles of cycling shoes are typically rigid to promote transfer of force from the foot to the pedal. Once a cyclist dismounts, they often must walk around in the cycling shoe as it is cumbersome to continually put on and take off the cycling shoe and put on a conventional shoe when the cyclist mounts and dismounts a bicycle. Transporting around a pair of conventional shoes when cycling is burdensome. Wearing a cycling shoe when walking around is undesirable. The cleat for conventional cycling shoes protrudes from the front portion of the shoe and creates an uneven contact with ground between the heel and the cleat when the cyclist walks in the cycling shoe. Further, when a cyclist dismounts, the cleat is in direct contact with the ground. Contact with the ground risks damage to the cleat on the cycling shoe when the cyclist walks on certain outdoor surfaces such as asphalt or concrete. Walking with cycling shoes on other surfaces such as grass, gravel, cinders, and other landscape materials allows those materials to adhere to and/or become stuck in and around the cleat and the shoe's cleat mounting plate. In addition, the contact with the ground by the cleat also may damage certain floor surfaces when the cyclist walks indoors wearing a cycling shoe.

Further the cleat makes it difficult to walk in cycling shoes because of a lack of traction on indoor floor surfaces from the smooth, hard soles of most cycling shoes. Further, a typical cycling shoe has a differential in height of the front of shoe and the heel due to the cleat location at the toe of the shoe. In addition, the rigid sole of the cycling shoe prevents the shoe from flexing while walking. The absence of a natural heel to toe roll because of the height differential also makes walking in cycling shoes difficult and dangerous. Walking long distances in the cycling shoe on hard surfaces also risks damage to the cleat itself.

Thus, currently cyclists must exercise caution and risk damage to their cycling shoe or walking surfaces when they dismount and walk in the cycling shoes if they do not or cannot switch to conventional shoes when cycling. Cyclists may protect the cleat when they walk in the cycling shoes by using a specially designed plastic snap-on cap to cover the cleat or another protector designed for only the front of the cycling shoe. Although the snap-on cap may protect the cleat, it does not assist in making walking easier or safer in cycling shoes as the contacts made by the cycling shoe with the ground remains uneven. Moreover, such caps may often be lost or forgotten when the cyclist remounts their cycle. Other alternatives do not improve the differential between the front and back of the cycling shoe.

Thus, there is a need for a cover that may be used by a cyclist to protect the cleat of a cycling shoe and the cycling shoe itself when the cyclist is walking in the cycling shoe. There is also a need for a cover that may protect floor surfaces from damage from the cleat when a cyclist walks in cycling shoes indoors. There is a further need for a cover that may be folded for storage when not inserted on the cycling shoe. There is also a need for a cover that is sufficiently durable to protect the cycling shoe. There is a further need for a cycling shoe cover that decreases the differential between the front and back of the cycling shoe. There is also a need for cycling shoe cover that incorporates a heel design that promotes a natural, safe heel-to-toe roll with each step. There is a further need for a cover that may be folded for storage so that it is easily transportable when not inserted on the cycling shoe.

SUMMARY

One disclosed example is a cycling shoe cover having a pair of side panels and a toe coupled to one end of each of the pair of side panels forming a front pocket mateable with the toe of a cycling shoe. The cycling shoe cover also includes a heel coupled to the opposite end of each of the pair of side panels forming a back pocket mateable with the heel of a cycling shoe. The cycling shoe cover also includes a sole member having a bottom surface joined to the pair of side panels. The bottom surface of the sole member is interposed between the cycling shoe and a ground surface when the shoe cover is worn over the cycling shoe.

Another disclosed example is a method of protecting a cycling shoe when worn by a cyclist when walking. A cycling shoe cover is inserted over the cycling shoe. The cycling shoe cover includes a pair of side panels and a toe coupled to one end of each of the pair of side panels forming a front pocket mateable with the toe of a cycling shoe. The cycling shoe cover also includes a heel coupled to the opposite end of each of the pair of side panels forming a back pocket mateable with the heel of a cycling shoe. The cycling shoe includes a sole member having a bottom surface. The bottom surface of the sole member is interposed between the cycling shoe and a ground surface when the cycling shoe cover is inserted over the cycling shoe.

The foregoing and additional aspects and implementations of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

Figure 1:
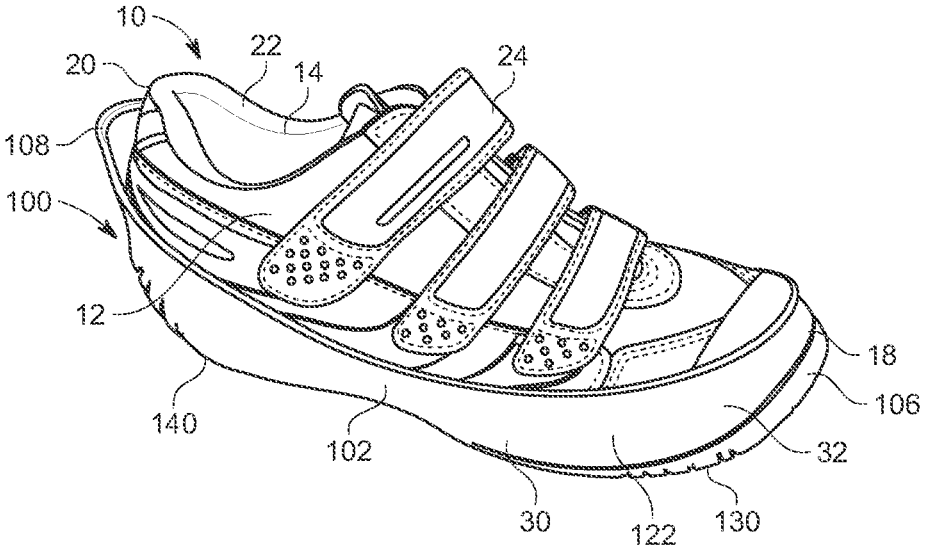
FIG. 1 is a perspective view of a cycling shoe cover slipped over a cycling shoe.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

Figure 2:
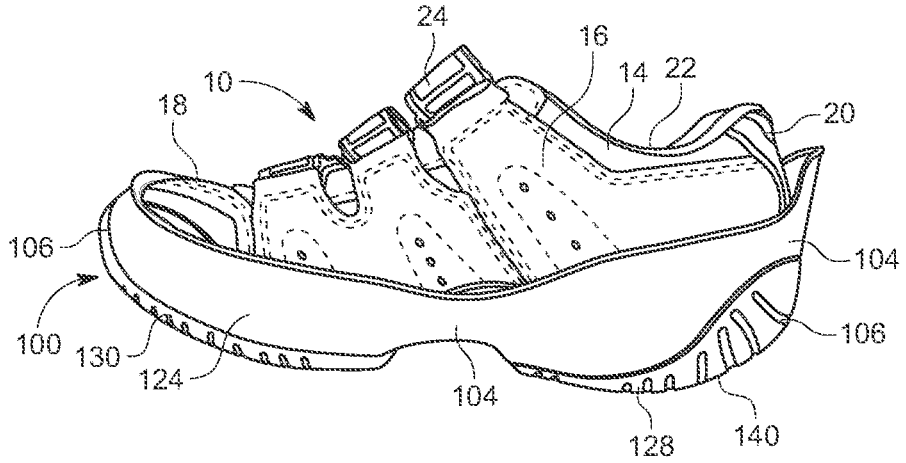
FIG. 2 is a side view of the cycling shoe cover in FIG. 1 slipped over the cycling shoe.

FIG. 1 is a perspective view of a cycling shoe 10 and a cycling shoe cover 100. FIG. 2 is a perspective view of the cycling shoe cover 100 slipped over the cycling shoe 10. The cycling shoe 10 includes a body 12 that has side panels 14 and 16 that are attached to a toe 18 and a heel 20. The body 12 has a collar 22 that forms an opening to allow the cyclist to insert their foot in the cycling shoe 10. The body 12 includes straps 24 that allow the side panels 14 and 16 of the body 12 to be tightened around the foot of the cyclist. The cycling shoe 10 includes a sole 30 that includes a toe cleat 32 that mates with a corresponding toe clip on the pedal of a bicycle. In this manner, the contact between the toe cleat 32 and the toe clip on the pedal allows the cyclist to efficiently translate force through their leg to the pedal.

Figure 3:
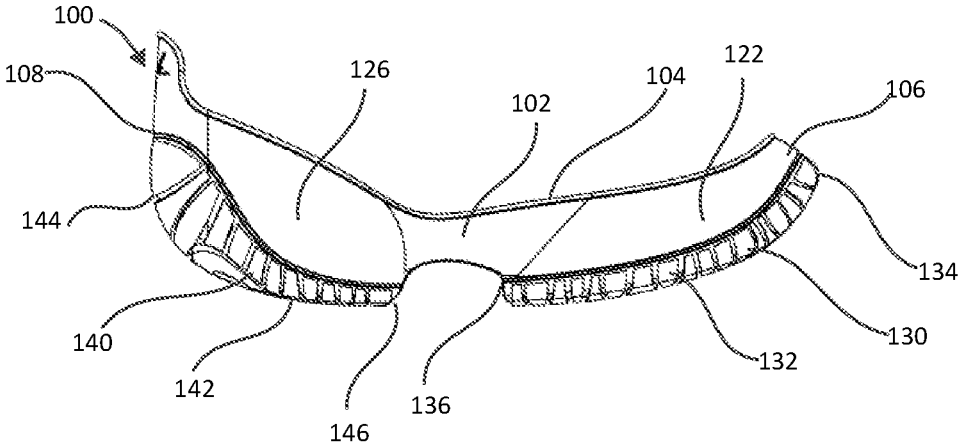
FIG. 3 is a side view of the cycling shoe cover in FIG. 1.
Figure 4:
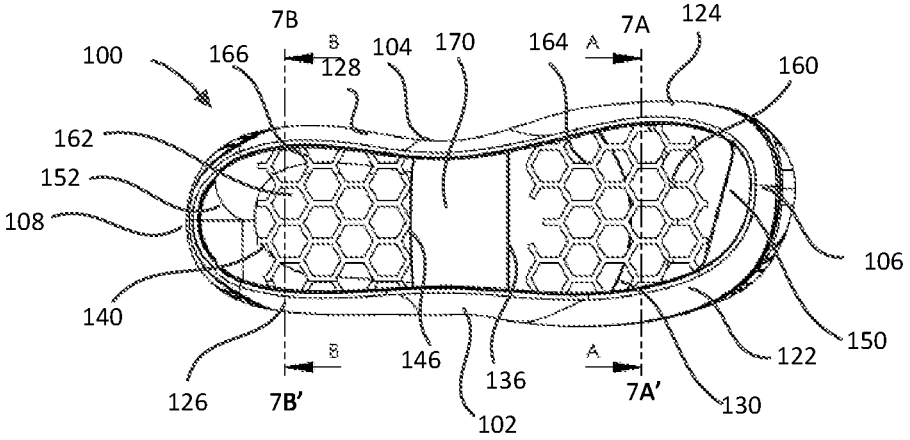
FIG. 4 is a top view of the cycling shoe cover in FIG. 1.
Figure 5:
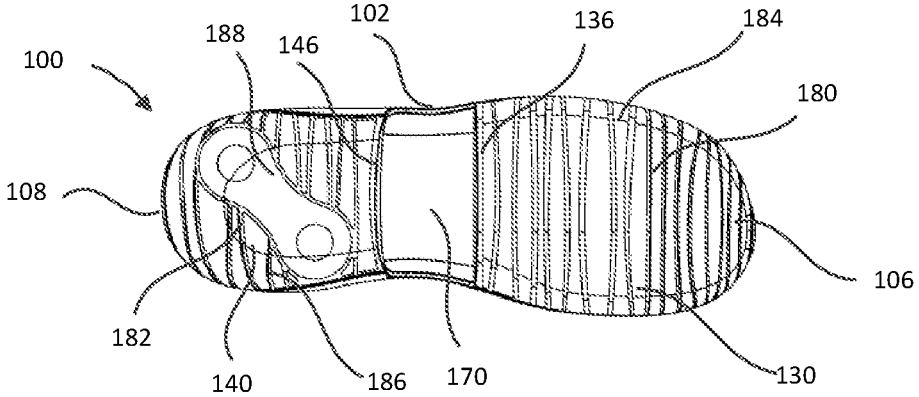
FIG. 5 is a bottom view of the cycling shoe cover of FIG. 1.
Figure 6A:
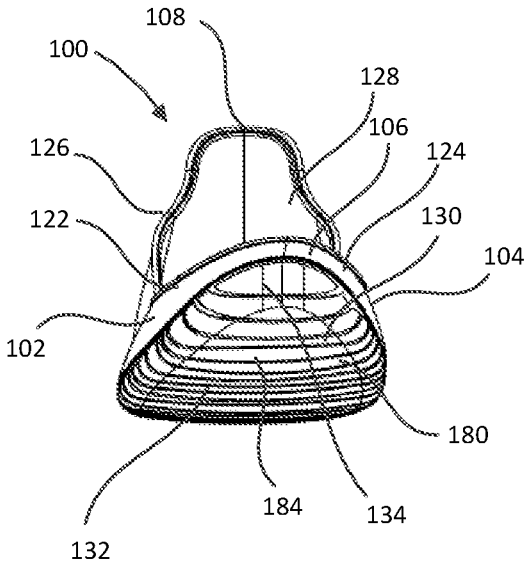
FIG. 6A is a front view of the cycling shoe cover in FIG. 1.
Figure 6B:
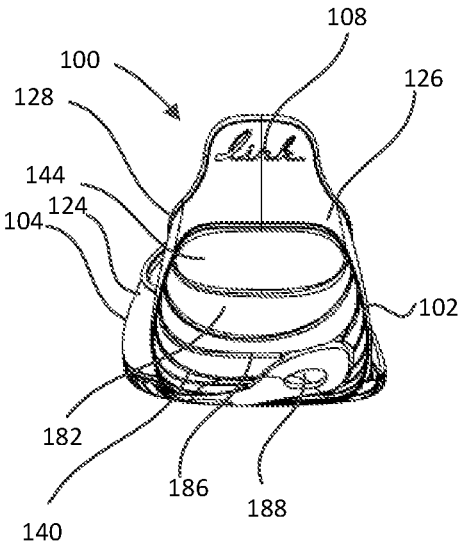
FIG. 6B is a back view of the cycling shoe cover in FIG. 1.
Figure 7A:
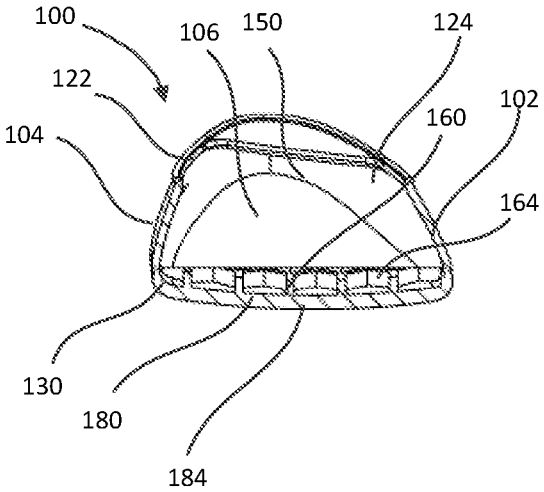
FIG. 7A is a cross-section view of the cycling shoe cover in FIG. 1 along line 7A-7A' in FIG. 4.
Figure 7B:
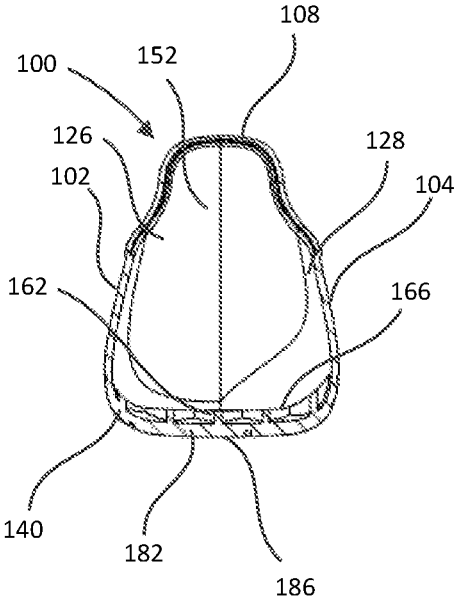
FIG. 7B is a cross-section view of the cycling shoe cover in FIG. 1 along line 7B-7B' in FIG. 4.

The cycling shoe cover 100 is shown in detail in FIGS. 3-7. Specifically, FIG. 3 is a side view of the cycling shoe cover 100, FIG. 4 is a top view of the cycling shoe cover 100 and FIG. 5 is a bottom view of the cycling shoe cover 100. FIG. 6A is a front view of the cycling shoe cover 100 and FIG. 6B is a back view of the cycling shoe cover 100. FIG. 7A is a cross-section view along line 7A-7A' in FIG. 4 and FIG. 7B is a cross-section view of the cycling shoe cover 100 in FIG. 4 along line 7B-7B'.

In particular, the cycling shoe cover 100 includes a pair of side panels 102 and 104. The side panels 102 and 104 are joined by a toe member 106 on one of their respective sides and a heel member 108 on the opposite side of the respective sides. The side panels 102 and 104 each have a forward area 122 and 124 respectively and a back area 126 and 128 respectively. The forward areas 122 and 124 of the side panels 102 and 104 together with the toe member 106 are joined with a front sole panel 130. The front sole panel 130 has a bottom exterior sole surface 132. The front sole panel 130 has a roughly semi-circular closed front end 134 that is attached to the forward areas 122 and 124 to join the toe 106. The front sole panel 130 also has an opposite roughly straight back end 136 that spans between the opposite ends of the forward areas 122 and 124.

The back areas 126 and 128 of the side panels 102 and 104 together with the heel member 108 are joined with a back sole panel 140. The back sole panel 140 has a bottom exterior sole surface 142. The back sole panel 140 has a closed back end 144 that is attached to the back areas 126 and 128 to join the heel member 108. The back sole panel 140 also has an opposite front end 146 that spans between the opposite ends of the back areas 126 and 128. The front sole panel 130 and the back sole panel 140 together form a sole member that has a bottom surface interposed between the cycling shoe 10 and the ground surface when the cycling shoe cover 100 is inserted over the cycling shoe 10.

The front sole panel 130 in conjunction with the side members 102 and 104 form a front pocket 150 that is in contact with the toe 18 of the cycling shoe 10 shown in FIG. 1 when the cover 100 is slipped over the cycling shoe 10. The back sole panel 140 in conjunction with the side members 102 and 104 form a back pocket 152 that is in contact with the heel 20 of the cycling shoe 10 when the cover 100 is slipped over the cycling shoe 10. FIGS. 1 and 2 show the cycling shoe cover 100 that is slipped over the cycling shoe 10 to enable protection of the cycling shoe 10 when the cyclist dismounts and desires to walk in the cycling shoe 10. The heel member 108 has a rounded exterior to promote a natural heel to toe roll when the cycling shoe cover 100 is slipped over the cycling shoe 10.

As shown in detail in FIG. 4, the respective front sole panel 130 and back panel 140 have respective top surfaces 160 and 162 to rest the cycling shoe 10 when the cover 100 is slipped over the cycling shoe 10. A honeycomb pattern 164 is formed on the top surface 160 of the front panel 130 that assists in cushioning the toe cleat 32 of the cycling shoe 10. The honeycomb pattern 164 includes various depressions between support ribs in the honeycomb pattern. The honeycomb pattern 164 is formed at a predetermined height relative to the top surface 160 of the front sole panel 130. The height of the honeycomb pattern 164 is sufficient to be substantially the same height as the cleat of a cycling shoe. A honeycomb pattern 166 is formed on the top surface 162 of the back panel 140 to provide support for the heel of a cyclist when the cover 100 is slipped over a cycling shoe. The height of the honeycomb pattern 166 is roughly the same as the honeycomb pattern 164. Of course other shapes of patterns may be formed in the top surfaces 160 and 162 to provide cushioning and to hold the cleat of the cycling shoe 10. The back end 136 of the front sole panel 130 and the front end 146 of the back sole panel 140 in conjunction with the side panels 102 and 104 form an opening 170 in the bottom of the cover 100.

FIG. 5 shows a bottom surface 180 of the front sole panel 130 and a bottom surface 182 of the back sole panel 140. The respective bottom surfaces 180 and 182 have a raised stripped pattern 184 and 186 that aids in contact with a ground surface when a user wears the cycling shoe cover 100 over the cycling shoe 10. The bottom surface 182 of the back sole panel 140 includes an imprinted logo designation 188.

In this example, the cycling shoe cover 100 may be made to have different standard sizes to fit ranges of sizes of cycling shoes. For example, the cycling shoe cover 100 may have several different standard widths to accommodate varying widths of shoes. The cycling shoe cover 100 may also have several different standard lengths to accommodate varying lengths of shoes. Since the cycling shoe cover 100 is fabricated from an elastic material, one size of the shoe cover may be adapted to a range of cycling shoes of standard shoe sizes. The side panels 102 and 104 may be stretched to allow for one size of the cycling shoe cover to span multiple shoe sizes. The elasticity of the cycling shoe cover 100 allows it to be fit over a variety of toe and heel contours of different types of cycle shoes. In this example, the heel infrastructure of the shoe 10 created by the heel 108 and the back areas 126 and 128 of the side panels 102 and 104 is designed to accommodate the average differential created by the different types of cleats of different cycling shoes.

In this example the cycling shoe cover 100 is made of a durable and stretchable material such as rubber, plastic, silicone, composites, or the like to provide protection for the cycling shoe 10 but with sufficient elasticity to facilitate slipping the shoe cover 100 on and off the cycling shoe 10. The material may be durable enough to withstand the wear and tear of the cyclist walking with the cycling shoe cover 100 over the cycle shoe 10. The material is also washable to allow cleaning of the cycling shoe cover 100. In this example, the material is 60 Shore A, Room Temperature Curing Silicone TC-5060 available from BJB Enterprises of Tusin, Calif.

Figure 8:
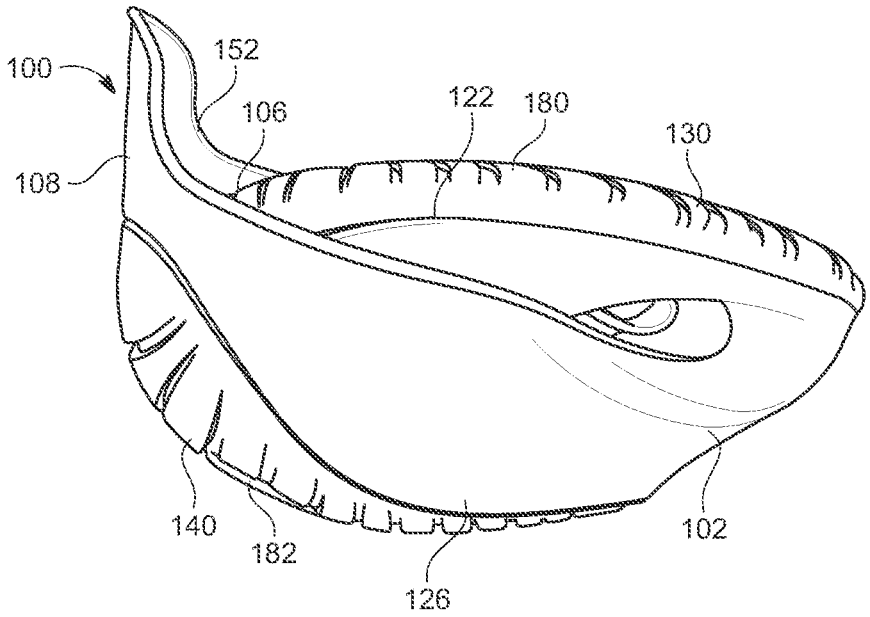
FIG. 8 is a side view of the cycling shoe cover in FIG. 1 being rolled-up for storage.

FIG. 8 shows the cycling shoe cover 100 folded up such that the toe 106 is tucked into the back pocket 152 formed by the heel 108 and bounded by the side panels 102 and 104. In this example the toe 106 is slightly narrower than the back pocket 152 and therefore may be retained by friction when inserted in the back pocket 152. The folded up cycling shoe cover 100 shown in FIG. 8 is compact and may be carried and stored easily by a cyclist when the cyclist is riding. The cycling shoe cover 100 may then be unfolded by detaching the toe 106 from the back pocket 152 when the cyclist dismounts and removes the cycling shoe cover 100 from storage. The removal of the toe 106 causes the toe 106 to spring to the normal position shown in FIG. 3 and the cycling shoe cover 100 is ready to be attached to the cycling shoe 10.

After the cycling shoe cover 100 is unfolded, the front pocket 150 formed by the toe 106 may be slipped over the toe of the cycling shoe and the back pocket 152 formed by the heel 108 may be slipped over the heel of the cycling shoe. The cycling shoe then rests against the sole of the cover 100 formed by the front sole panel 130 and the back sole panel 140. A second cycling shoe cover is slipped over the opposite cycling shoe in a similar fashion and the cyclist may then walk in the cycling shoes protected by the cycle shoe cover 100. Of course, when the cyclist finishes walking with the cycling shoe cover 100 installed over the cycling shoe 10, the cyclist may remove the cycling shoe cover 100 from the cycling shoe 10 and tuck the toe 106 into the back heel pocket 152 and store the now folded cycling shoe cover 100 for future use.

The cycling shoe cover 100 according to the above example reduces the potential for damage to the cycling shoe and cleat while walking in cycling shoes when a cyclist dismounts. The honeycomb pattern 164 on the front sole panel 130 surrounds the toe cleat of a cycling shoe and thus prevents the toe cleat from contacting the ground. The bottom surface of cycling shoe cover 100 formed by the bottom surfaces 180 and 182 of the front sole panel 130 and the back sole panel 140 respectively reduces the potential for damage to indoor and outdoor surfaces while a cyclist is wearing cycling shoes while walking. The irregular patterns 184 and 186 at the bottom surfaces 180 and 182 of the cycling shoe cover 100 allow traction on indoor floor surfaces. The resilient but soft material of the cycling shoe cover 100 prevents damage to the indoor floor surfaces.

The differential in height between the front of the cycling shoe and the heel of the cycling shoe is compensated by the heel infrastructure in the form of the raised honeycomb pattern 166 on the back sole panel 140 of the cycling shoe cover 100 when it is inserted over the cycling shoe. When the cycling shoe cover 100 is worn, the combination of the front sole panel 120 and the back sole panel 140 thus creates a flat surface for the cyclist to walk therefore providing a natural heel to toe roll when walking. The rounded exterior of the heel 108 also promotes a natural heel to toe roll.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A cycling shoe cover for mating with a cycle shoe having a toe with a protruding cleat and an opposite heel, the cycling shoe cover comprising:

a pair of side panels;

a front toe sole panel coupled to one end of each of the pair of side panels forming a front pocket mateable with the toe of the cycling shoe;

a back heel sole panel coupled to the opposite end of each of the pair of side panels forming a back pocket mateable with the heel of the cycling shoe, wherein the side panels run parallel to the cycling shoe over the length of the cycling shoe between the front toe sole panel and the back heel sole panel and connects the front toe sole panel and the back heel sole panel;

a sole member formed from the front toe sole panel and the back toe sole panel, the sole member having a bottom surface interposed between the cycling shoe and a ground surface when the shoe cover is worn over the cycling shoe, wherein the bottom surface of the sole member is discontinuous having a through aperture extending through the sole member at an arch area of a foot in the shoe and separating the front toe sole panel and the back heel sole bottom panel; and wherein the sole member includes a top surface having a raised pattern having support ribs and depressions, the raised pattern including a front area in the front toe sole panel to interface with the cleat of the cycling shoe; wherein the raised pattern includes a back area in the back heel sole panel having a greater height than the front area in the front toe sole panel.

2. The cycling shoe cover of claim 1, wherein the cycling shoe cover is constructed of silicone material.

3. The cycling shoe cover of claim 1, wherein the bottom surface of the sole member has an irregular surface.

4. The cycling shoe cover of claim 1, wherein the toe and heel may be folded together to place the shoe cover in a storage configuration.

5. The cycling shoe cover of claim 1, wherein the raised pattern is in a honeycomb shape.

6. The cycling shoe cover of claim 1, wherein the heel has a rounded exterior surface.

7. A method of protecting a cycling shoe when worn by a cyclist when walking, the cycling shoe having a toe with a protruding cleat and an opposite heel, the method comprising:

inserting a cycling shoe cover over the cycling shoe, the cycling shoe cover including:

a pair of side panels;

a front toe sole panel coupled to one end of each of the pair of side panels forming a front pocket mateable with the toe of the cycling shoe;

a back heel sole panel coupled to the opposite end of each of the pair of side panels forming a back pocket mateable with the heel of the cycling shoe, wherein the side panels run parallel to the cycling shoe over the length of the cycling shoe between the front toe sole panel and the back heel sole panel and connects the front toe sole panel and the back heel sole panel;

a sole member formed from the front toe sole panel and the back toe sole panel, the sole member having a bottom surface, wherein the bottom surface of the sole member is discontinuous having a through aperture extending through the sole member at an arch area of a foot in the shoe and separating the front toe sole panel and the back heel sole panel; and wherein the bottom surface of the sole member is interposed between the cycling shoe and a ground surface when the cycling shoe cover is inserted over the cycling shoe; and wherein the sole member includes a top surface having a raised pattern having support ribs and depressions, the raised pattern including a front area in the front toe sole panel to interface with the cleat of the cycling shoe; wherein the raised pattern includes a back area in the back heel sole panel having a greater height than the front area in the front toe sole panel.

8. The method of claim 7, wherein the cycling shoe cover is constructed of silicone material.

9. The method of claim 7, wherein the bottom surface of the sole member has an irregular surface.

10. The method of claim 7, wherein the toe and heel may be folded together to place the shoe cover in a storage configuration.

11. The method of claim 7, wherein the raised pattern is in a honeycomb shape.

12. The method of claim 7, wherein the heel has a rounded exterior surface.

13. A cycling shoe cover for mating with a cycle shoe having a toe with a protruding cleat and an opposite heel, the cycling shoe cover comprising:

a pair of side panels;

a front toe sole panel coupled to one end of each of the pair of side panels forming a front pocket mateable with the toe of the cycling shoe;

a back heel sole panel coupled to the opposite end of each of the pair of side panels forming a back pocket mateable with the heel of the cycling shoe, wherein the side panels run parallel to the cycling shoe over the length of the cycling shoe between the front toe sole panel and the back heel sole panel and connects the front toe sole panel and the back heel sole panel;

a sole member having an arch, a top surface and an opposite bottom surface, the sole member joined to the pair of side panels, the bottom surface of the sole member interposed between the cycling shoe and a ground surface when the shoe cover is worn over the cycling shoe, and the top surface having a raised pattern, the raised pattern having supporting ribs and depressions, the raised pattern including a front area to interface with the cleat of the cycling shoe and a back area of the raised pattern having a greater height than the front area of the raised pattern, and wherein the bottom surface of the sole member is discontinuous having a through aperture extending through the sole member at an arch area of a foot in the shoe and separating the front toe sole panel and the back heel sole bottom panel.

* * * * *